US007341040B1

(12) United States Patent
Wiesen

(10) Patent No.: US 7,341,040 B1
(45) Date of Patent: Mar. 11, 2008

(54) SUPERCHARGED TWO-CYCLE ENGINES EMPLOYING NOVEL SINGLE ELEMENT RECIPROCATING SHUTTLE INLET VALVE MECHANISMS AND WITH A VARIABLE COMPRESSION RATIO

(76) Inventor: Bernard Wiesen, 15 Beach Rd., Great Neck, NY (US) 11023

( * ) Notice: Subject to any disclaimer, the term of this patent is extended or adjusted under 35 U.S.C. 154(b) by 0 days.

(21) Appl. No.: 11/486,460

(22) Filed: Jul. 14, 2006

Related U.S. Application Data

(60) Provisional application No. 60/700,231, filed on Jul. 14, 2005.

(51) Int. Cl.
*F01L 3/20* (2006.01)

(52) U.S. Cl. ..... 123/200; 123/65 V

(58) Field of Classification Search ..... 123/200, 123/65 V, 65 VA, 65 BA, 73 AV, 73 V, 58.5, 123/58.6, 55.2, 53.3
See application file for complete search history.

(56) References Cited

U.S. PATENT DOCUMENTS 2,018,848 A * 10/1935 Gruebler ..... 123/65 BA
2,814,282 A * 11/1957 Gross ..... 123/73 B
5,261,359 A * 11/1993 Hull ..... 123/65 V
5,769,040 A * 6/1998 Christner et al. ..... 123/65 V

* cited by examiner

*Primary Examiner*—Stephen K. Cronin
*Assistant Examiner*—Hyder Ali

(57) ABSTRACT

This invention relates to novel reciprocating shuttle inlet valves, effective with every type of two-cycle engine, from small high-speed single cylinder model engines, to large low-speed multiple cylinder engines, employing spark or compression ignition. Also permitting the elimination of out-of-phase piston arrangements to control scavenging and supercharging of opposed-piston engines. The reciprocating shuttle inlet valve (32) and its operating mechanism (34) is constructed as a single and simple uncomplicated member, in combination with the lost-motion abutments, (46) and (48), formed in a piston skirt, obviating the need for any complex mechanisms or auxiliary drives, unaffected by heat, friction, wear or inertial forces. The reciprocating shuttle inlet valve retains the simplicity and advantages of two-cycle engines, while permitting an increase in volumetric efficiency and performance, thereby increasing the range of usefulness of two-cycle engines into many areas that are now dominated by the four-cycle engine.

4 Claims, 17 Drawing Sheets

*Fig. 11.*

Duration of the Various Compressor and Power Piston Strokes with Valve and Port Positions in the Typical Wiesen Two-Cycle Engine Outer Ring Shows Duration of Various Events Related to the Compressor Cylinder Center Loop Shows Duration and Timing of the Reciprocating Shuttle Inlet Valve Between the Plenum and Cylinder When in the Open Position Inner Ring Shows Duration of Various Events Related to the Power Cylinder

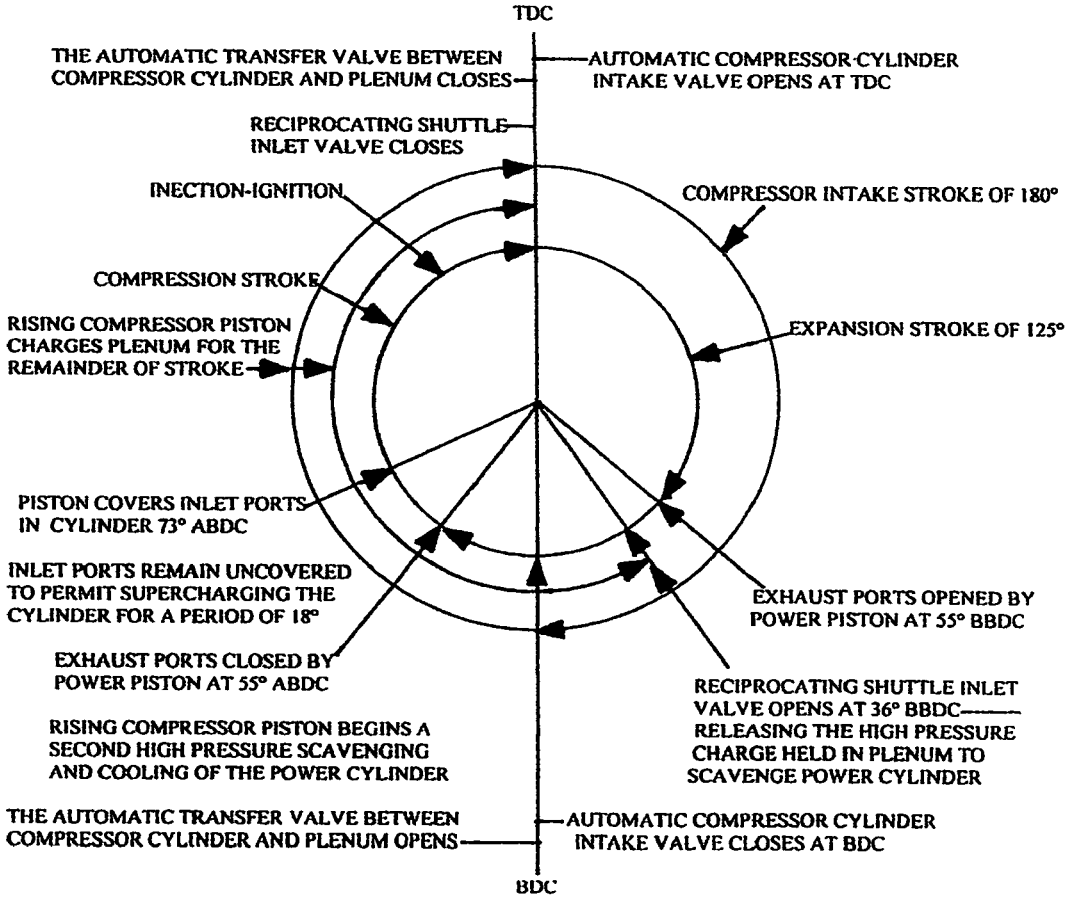

VARIOUS RECIPROCATING SHUTTLE INLET VALVES FOR DIFFERENT CYLINDER TYPES

CYLINDER AND VALVE FOR OPPOSED EXHAUST PORTS

CYLINDER AND VALVE FOR A SINGLE EXHAUST PORT

CYLINDER AND VALVE FOR AN OPPOSED-PISTON ENGINE

SUPERCHARGED TWO-CYCLE ENGINES EMPLOYING NOVEL SINGLE ELEMENT RECIPROCATING SHUTTLE INLET VALVE MECHANISMS AND WITH A VARIABLE COMPRESSION RATIO

CROSS-REFERENCE TO RELATED APPLICATIONS

This application claims the priority benefit of U.S. Provisional Patent Application Ser. No. 60/700,231 filed on Jul. 14, 2005.

STATEMENT OF GOVERNMENT INTEREST

This invention was made in part with United States Government support under Contract No. NAS3-01035 awarded by the National Aeronautics and Space Administration (NASA). The United States Government has certain rights in the claims of this invention and any resulting patent.

BACKGROUND OF THE INVENTION

The present invention relates to supercharged two-cycle engines and more particularly to novel reciprocating shuttle inlet valves highly suited for employment with all engines in this category, designed to permit the effective supercharging and scavenging of an engine cylinder. The entire reciprocating shuttle inlet valve and its operating mechanism is constructed as a single and simple uncomplicated member, operated by an ingenuous lost-motion arrangement between the reciprocating shuttle inlet valve, the engine cylinder and abutments at the ends of voids formed in the piston skirt, providing an ideal arrangement that obviates the need for any complex mechanisms or auxiliary drives and is totally unaffected by heat, wear or inertial forces. The invention is advantageously combined with the stepped-piston/supercharging arrangement of the preferred embodiment of the invention. It has been demonstrated that all future internal combustion engines will require some supercharging arrangements in order to fulfill the continually increasing demands for reduced emissions and improved fuel economy.

BACKGROUND OF SINGLE-PISTON TWO-CYCLE ENGINES AND DESCRIPTION OF PRIOR ART

Two-cycle engines that operate with a single piston reciprocating within each cylinder, without using auxiliary valves, are always constructed with symmetrical timing, which means that within the two-stroke cycle of operation, the exhaust ports open before and close after the inlet ports in the cylinder. Therefore no supercharging pressure can be built up and held in the cylinder over a useful band of rev/min. In order to rapidly and effectively uniflow scavenge and pressure-charge the cylinders of single piston, two-cycle engines, it has been necessary to employ some valve mechanism for at least one function of the scavenging process, but all of the many types of valves proposed have required a large increase in both complexity and cost that eliminates some of the major advantages of the two-cycle engine and has therefore prohibited their general use.

It is necessary to emphasize the importance of the very high volumetric efficiency of the piston controlled ports employed by the standard two-cycle engine. Until now no existing type of inlet valve could produce the essential requirements of presenting the maximum throughway inlet area to the air in the minimum time. In view of this, the only form of inlet valve mechanism ever having any prospect of success in achieving two-cycle asymmetrical timing, is one which assists the piston-port function, rather than by superseding it. Those inlet valves and their operating gear which have come nearest to it are so complicated and expensive that the are unacceptable.

Two-cycle engines without valves cannot benefit from the advantages of uniflow scavenged and efficiently supercharged engines, which are increased horsepower from a given displacement or weight and manufactured at a lower cost than naturally aspirated engines of the same power, also with improved idle and light load operation and increased fuel economy with reduced emissions.

BACKGROUND OF OPPOSED-PISTON TWO-CYCLE ENGINES AND DESCRIPTION OF PRIOR ART

Conventional opposed-piston engines generally operate on the two-stroke cycle, requiring the pistons to function in an out-of-phase mode to control scavenging and supercharging. The more out-of-phase the opposed-pistons are arranged, to increase the time allowed for scavenging and supercharging, the further apart the piston crowns are when the leading piston reaches top dead center and the more detrimental this arrangement is in regard to combustion efficiency.

Altering the phase relationship between opposed-pistons inhibits the construction of an efficient combustion chamber, one that could employ squish bands between the opposed-piston crowns that squeezes the swirling air and fuel mixture into piston combustion bowls and prevent the formation of unburned pockets of fuel. This out-of-phase piston arrangement also complicates the problem of obtaining a balance of the opposing inertial forces of the pistons, whereby the potential advantages of opposed-piston two-cycle engines are lost.

An often unrecognized consequence resulting from this out-of-phase piston arrangement is that there is a substantial disparity in the amount of power transmitted to the shaft from the leading piston, which is essentially much greater than that transmitted from the following piston, by as much as 20% or even more. This disparity increases with the phase angle and constitutes an inherent flaw in engines of this category.

In general, the opposed-piston two-cycle uniflow scavenged and supercharged engine is very attractive when high specific output is important. This engine also has both excellent scavenging efficiency and very high flow conditions, thus leading toward high mean effective pressures and therefore was formerly favored for use in both locomotive and submarine engines on account of its performance, low specific weight and good fuel economy.

This engine type was the basis of the only successful military and commercial diesel aircraft engine, incidentally still holding the record for high specific output of a production diesel aircraft engine. It remains a question as to whether the increased specific output outweighs the disadvantages of the required out-of-phase mechanical arrangements and the type's inability to keep pace with the current demands for improved in-cylinder combustion technology.

BACKGROUND OF SUPERCHARGED TWO-CYCLE ENGINES

Almost all previous two-cycle engines that employed valve mechanisms for at least one function of the scavenging process were supercharged in one form or another. The term "supercharged" should properly include all arrangements that induce a volume of air, under pressure, into the engine cylinder that is measurably higher than atmospheric. These arrangements include all forms of positive displacement machines operating as a single mechanism or in combination with other mechanisms that do not totally rely on the "naturally aspirated" method.

All previous mechanisms employed to supercharge an engine cylinder may be combined with the reciprocating shuttle inlet valve of the present invention.

The supercharging mechanism of the preferred embodiment of the present invention is a double-diameter or stepped-piston, employed in a new arrangement with the reciprocating shuttle inlet valve. Previous stepped-pistons were used as a scavenging mechanism for two-cycle engines but without a uniflow scavenging valve mechanism are unable to supercharge an engine cylinder.

SUMMARY

This invention relates to supercharged engines that operate on the two-stroke cycle, and more particularly to novel reciprocating shuttle inlet valves, designed to significantly increase both the utility and the efficiency of the two-cycle engine, which may now be more efficiently scavenged and super-charged and effective with every type of two-cycle engine, from small high-speed single cylinder model engines, to large low-speed multiple cylinder engines, employing spark or compression ignition and operating with a stratified charge operation or with the formation of a homogenous charge compression ignition mixture. Also, the use of these reciprocating shuttle inlet valves permits the elimination of the conventional and inefficient out-of-phase piston arrangement used to control scavenging and supercharging in the opposed-piston two-cycle engine.

The entire reciprocating shuttle inlet valve and its operating mechanism is constructed as a single and simple uncomplicated member, operated by an ingenuous lost-motion arrangement between the reciprocating shuttle inlet valve, the engine cylinder and abutments at the ends of voids formed in the piston skirt, providing an ideal arrangement that obviates the need for any complex mechanisms or auxiliary drives and is totally unaffected by heat, friction, wear or inertial forces. Eliminating the need for the addition of a complex valve mechanism operated from the engine crankshaft or camshaft that requires the use of cams, shafts, connecting rods, levers, springs and other elements, some of which can be very expensive, requiring both precise manufacture and skilled assembly, with frequent maintenance and adjustment and many known problems involving lubrication and wear.

The reciprocating shuttle inlet valve moves very rapidly back and forth, advantageously stopping and pausing at the end of each stroke, to cover or uncover the supercharged inlet or scavenging ports in the cylinder. It is necessary to emphasize the importance of the very high volumetric efficiency of the piston controlled ports employed in this advanced two-cycle engine design. Until now no existing type of inlet valve could produce the essential requirements of presenting the maximum throughway inlet area to the air in the minimum time. By permitting the inlet ports in the cylinder, which are placed in a higher position than the exhaust ports, to be opened after the exhaust ports are opened and to remain open for a relatively long period of time after the piston controlled exhaust ports have closed, supercharging pressures well above atmospheric can be attained in the cylinder at all speeds. Therefore with an increased volume of air and much higher gas flow velocities, the engine cylinder is now more quickly and efficiently scavenged and supercharged, permitting a reduction of the exhaust port height to advantageously increase both the expansion and compression strokes, with the mean effective pressure thereby greatly increased.

Unlike crankcase compression engines, during the upward stroke, the stepped-piston/internal supercharging arrangement of the preferred embodiment of the invention, supplies a continued flow of air under pressure from the compressor cylinder through the one-way valves arranged between the compressor cylinder and plenum, this flow of compressed air continues into the power cylinder from the plenum to further scavenge and cool the cylinder. The compressed air continues to enter the plenum and power cylinder after the exhaust ports are closed and the supercharging of the cylinder has been completed. The compressed flow of air that continues to enter the plenum, after the inlet ports are covered by the rising power piston, is retained in the plenum under pressure, until the end of the expansion stroke and the lowering power piston opens the exhaust ports, when soon after this, the abutments formed in the piston skirt then make contact with the pins formed in the reciprocating shuttle inlet valve, forcing the reciprocating shuttle inlet valve to the open position, permitting the compressed air that is retained in the plenum to rush directly into the cylinder and perform the initial scavenging of the cylinder.

OBJECTS AND ADVANTAGES FOR SINGLE-PISTON ENGINES

The present invention has made the two-cycle engines that employ symmetrical timing of piston controlled inlet and exhaust ports, or complicated, expensive and difficult to manufacture valve mechanisms, an art in the past and has eliminated the problems that they suffer from.

Providing a reciprocating shuttle inlet valve operated without complex mechanical connections or precise manufacture and complication, consisting of a novel mechanism, which in practice is highly efficient at all engine speeds and the mechanical form of which is extremely simple. A very rapid port action is introduced by the reciprocating shuttle inlet valve precisely at that time in the cycle when it is most advantageous, simultaneously opening all the supercharged inlet ports in the cylinder, presenting the maximum throughway area to the air in the minimum time and permitting the cylinder to very quickly fill with air from a supercharged manifold or plenum.

The reciprocating shuttle inlet valve permits better air inlet opening and closing diagrams, better scavenging, highly improved supercharging and controlled exhaust port air loss. Eliminating the need for any complex valve mechanism operated from the engine crankshaft or camshaft that requires the use of cams, connecting rods, levers, springs and other elements, some of which are very expensive, requiring precise manufacture and skilled assembly with frequent maintenance and adjustment with many known problems involving lubrication and wear.

The present invention provides a reciprocating shuttle inlet valve with only one moving part and associated mechanism, forming a combination which causes the reciprocating shuttle inlet valve and port openings to function in proper timed relationship to the reciprocation of the piston, comprising a single member which moves very rapidly back and forth, advantageously stopping and pausing at the end of each stroke, to cover or uncover the supercharged inlet or scavenging ports in the cylinder. The absence of mechanical connections also eliminates a large number of moving parts, thereby considerably reducing the costs and maintenance requirements, while increasing reliability and retaining the relative simplicity of the standard two-cycle engine.

Providing that the supercharged inlet ports in the cylinders may be so formed that the charge entering through them may be configured to produce any desirable movement or a combination of different flow patterns for the various engine requirements and is received by the cylinders at its maximum entry pressure.

Unlike crankcase compression engines, the reciprocating shuttle inlet valves permit a continued flow of air under pressure from the plenum or manifold which also serves as an accumulator, directly into the cylinder after the exhaust ports have been closed.

Therefore with an increased volume of air and much higher gas flow velocities the cylinder is more quickly scavenged, permitting a reduction of the exhaust port height to advantageously increase both the expansion and compression strokes. The mean effective pressure is now greatly increased, while providing highly improved idling and light-load operation, permitting a level of volumetric efficiency and performance across a very wide range of operating speeds and parameters, not possible with the conventionally scavenged, unsupercharged, exhaust-tuned two-cycle engine, thereby increasing the range of usefulness of the two-cycle engine into many areas now dominated by the four-cycle engine.

The innovations described have resulted in the development of a new class of supercharged two-cycle engine and have made substantial improvements in the efficiency of this engine type.

OBJECTS AND ADVANTAGES FOR OPPOSED-PISTON ENGINES

The present invention has made the opposed-piston two-cycle engines that employ asymmetrical timing of the inlet and exhaust ports with an out-of-phase piston arrangement, or complicated, expensive and difficult to manufacture valve mechanisms, an art in the past and has eliminated the problems that they suffer from.

Only a small movement of the reciprocating shuttle inlet valve rapidly and simultaneously opens all the supercharged inlet ports in the cylinder, presenting the maximum throughway area to the air in the minimum time and permitting the cylinder to very quickly fill with air from a supercharged manifold or plenum.

There are many distinct advantages in engines of this improved opposed-piston type. Among the advantages is that the relative simplicity of the opposed-piston two-cycle engine is maintained and efficiency is also greatly improved due to the fact that the opposed-pistons have a constant relationship between the rims of their crowns at top dead center in order to efficiently promote the air movement in the combustion chamber and eliminate any pockets of unburned fuel.

Employing squish bands between the opposed-piston crowns that squeeze the swirling air and fuel mixture at a very high velocity into piston combustion bowls, considerably increasing the charge turbulence and intensifying the rate of combustion, assuring that the air and fuel will be thoroughly mixed and excited into a highly turbulent state and that combustion is completed in the shortest possible time. The lack of a squish area between the opposing piston crowns is highly disadvantageous due to the less favorable ignition conditions that thereby create increased noxious emissions.

In addition, the inlet ports opening and closing is so controlled, that supercharging is greatly improved and a substantially perfect balance of the opposing inertial forces is obtained, in that one opposed-piston does not trail the other, with both pistons in position to expand upon combustion at the same time. Altering the phase relationship between the opposed-pistons impairs the naturally very high level of dynamic balance within each cylinder that occurs when the opposed-pistons are in phase. The absence of mechanical connections reduces the number of moving parts, thereby reducing costs and maintenance requirements and increasing reliability.

The reciprocating shuttle inlet valve construction is distinguished by its extreme simplicity and consists of a single and simple member requiring no additional parts or precise manufacture, thereby retaining the relative simplicity of the opposed-piston two-cycle engine. The invention permits the opposed pistons to operate in unison and provides a much simpler and more compact construction in which the oppositely moving pistons and power transmitting mechanisms are arranged symmetrically. The present invention is applicable for use with any of the mechanical arrangements that have been employed to convert the reciprocating movements of the opposed-pistons to rotary motion.

The innovations described have resulted in the development of a new class of opposed-piston two-cycle engine and have made substantial improvements in the efficiency of this engine type. A great benefit of this arrangement is its enormous potential, contrasted with its appealing simplicity.

BRIEF DESCRIPTION OF THE DRAWINGS

FIG. 11. illustrates the complete cycle of the invention in simplified form.

REFERENCE NUMERALS IN DRAWINGS

Figure 1:
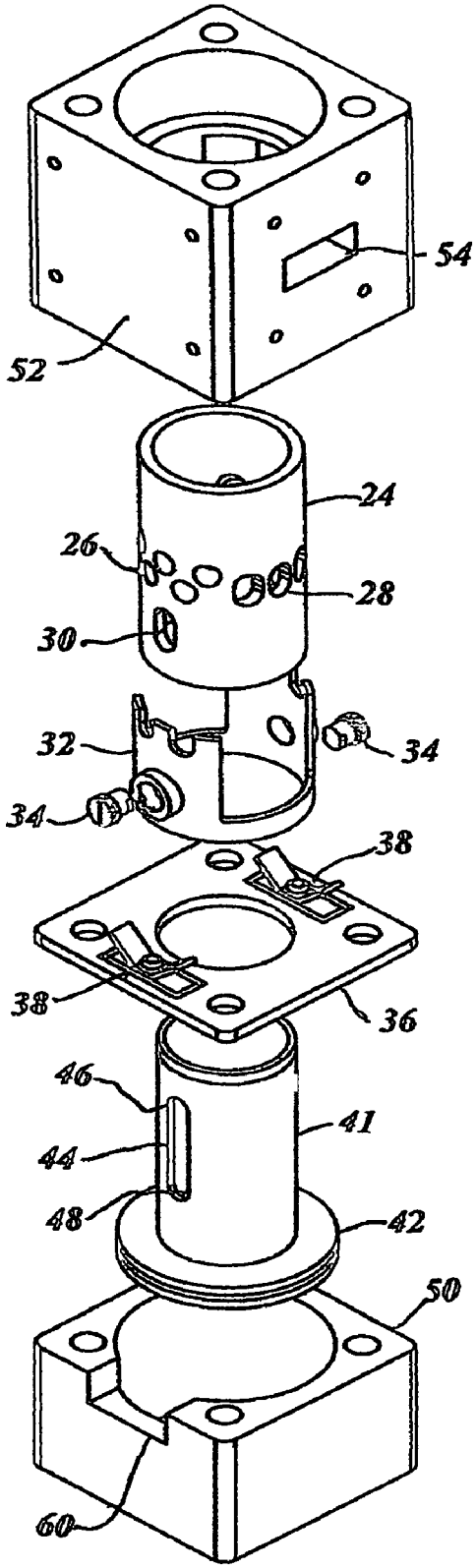
FIG. 1. is an exploded view showing some of the major elements of the invention as a single cylinder engine with opposed exhaust ports.
Figure 2:
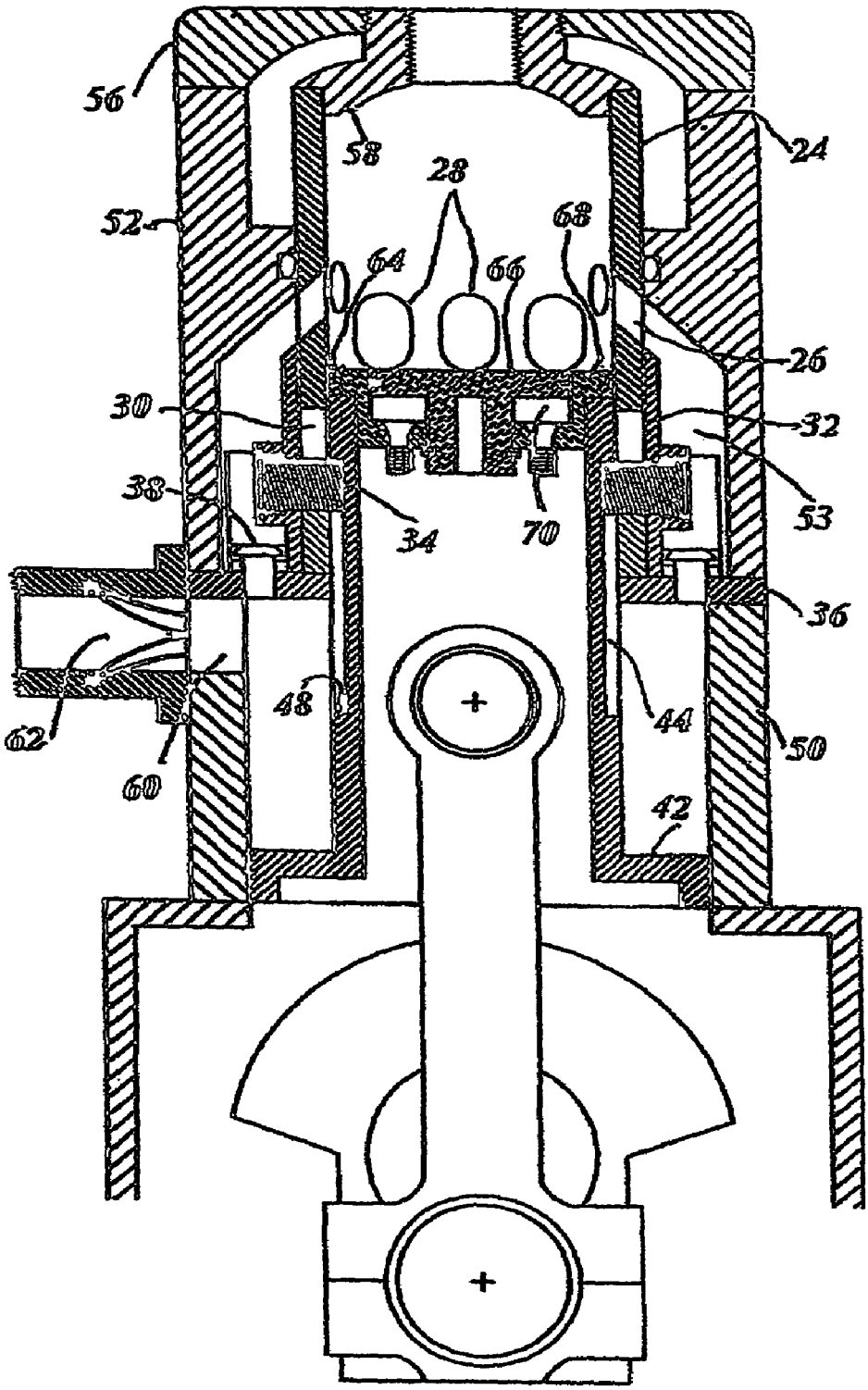
FIG. 2. is a vertical section through an engine cylinder constituting a first embodiment of the invention FIGS. 3-10. are vertical section drawings illustrating the new two-cycle arrangement of the present invention.
Figure 3:
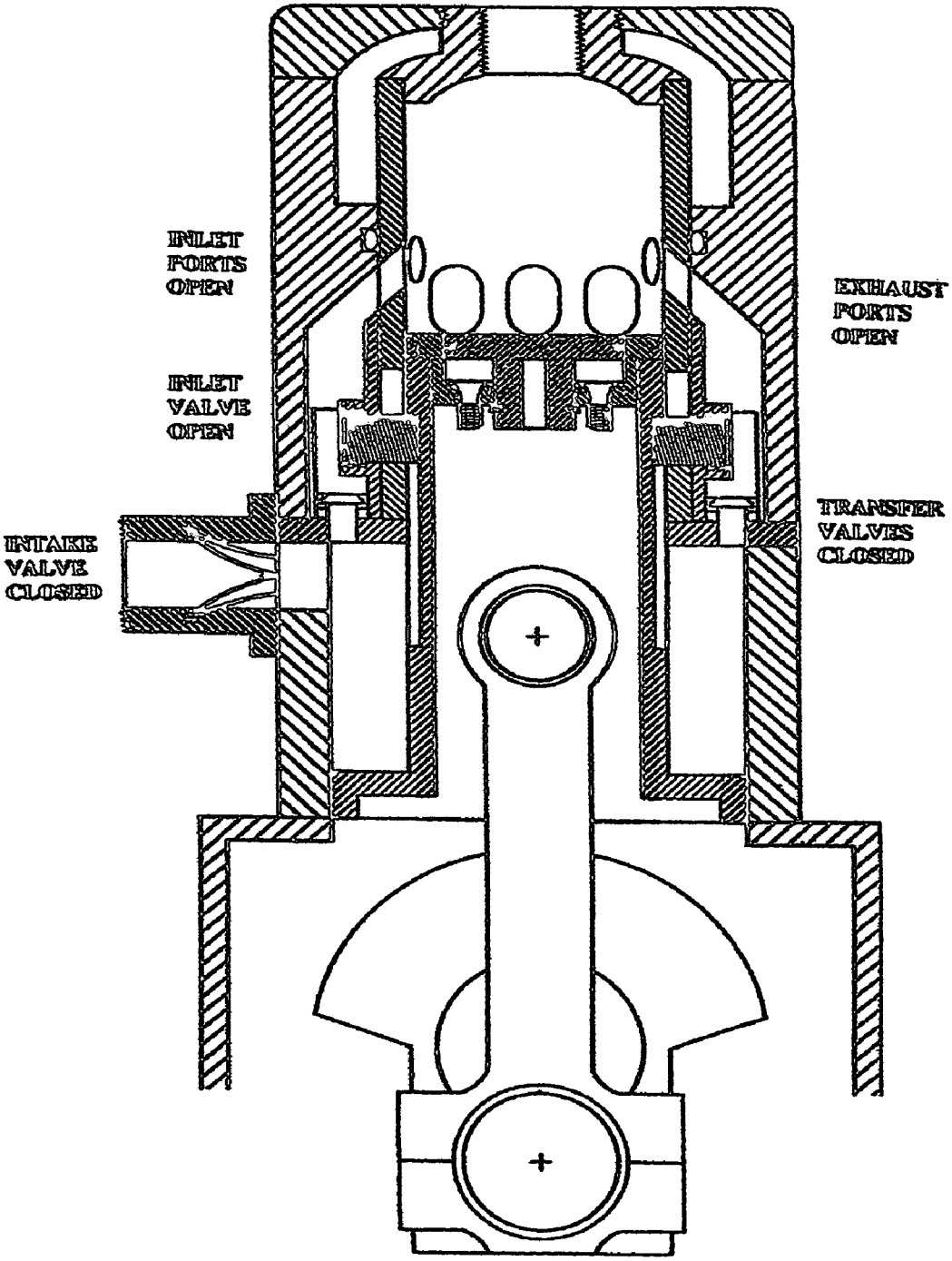
Figure 4:
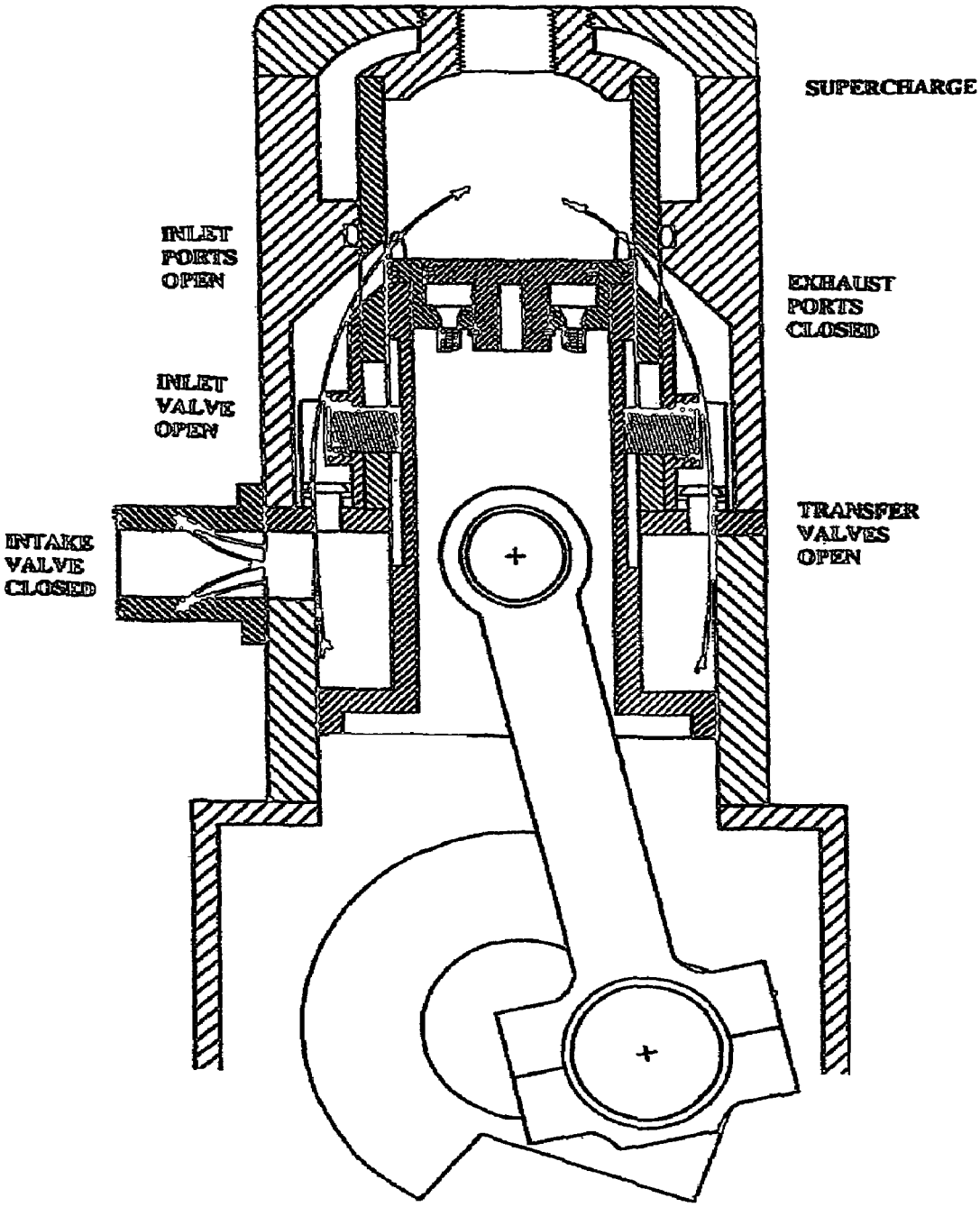
Figure 5:
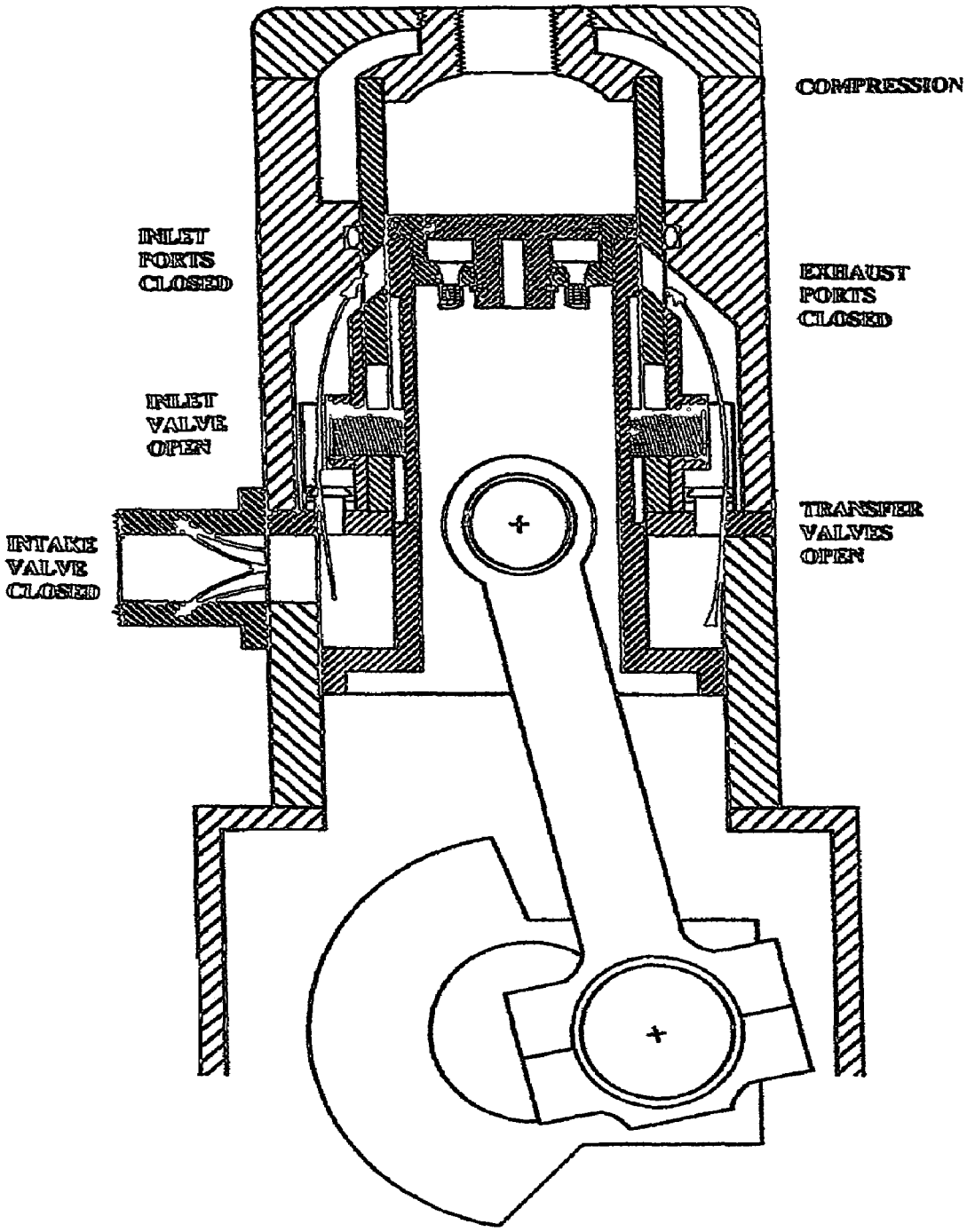
Figure 6:
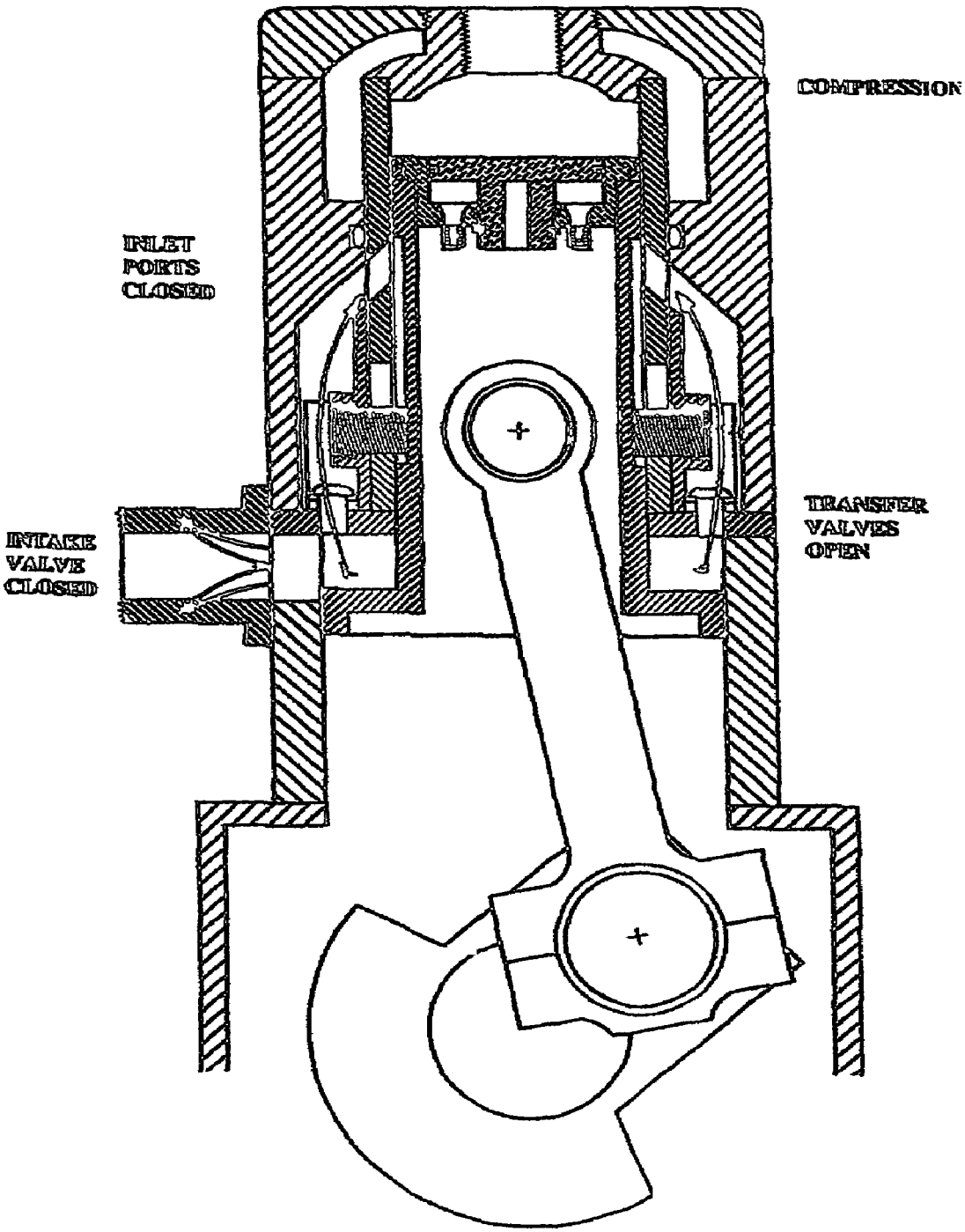
Figure 7:
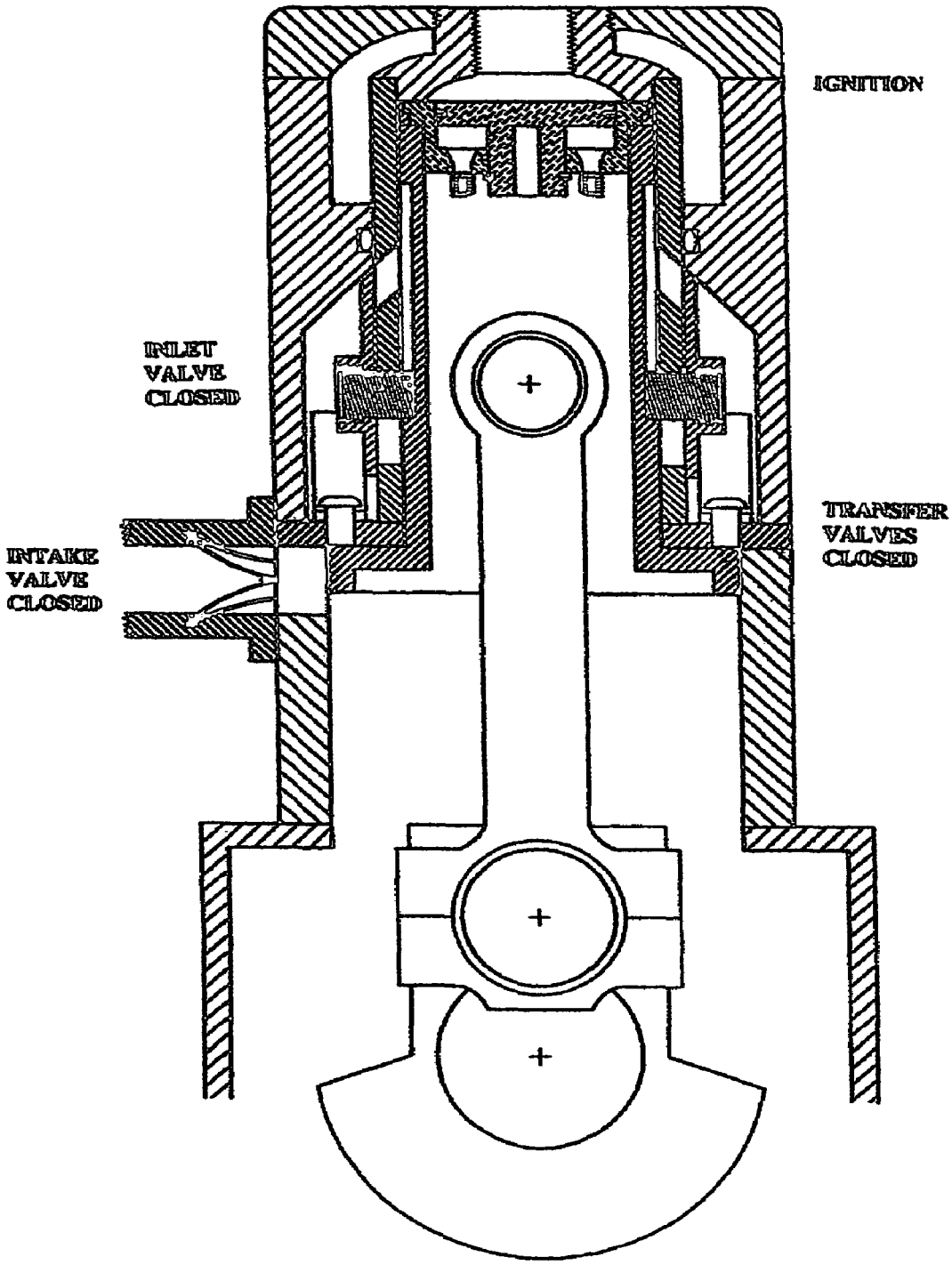
Figure 8:
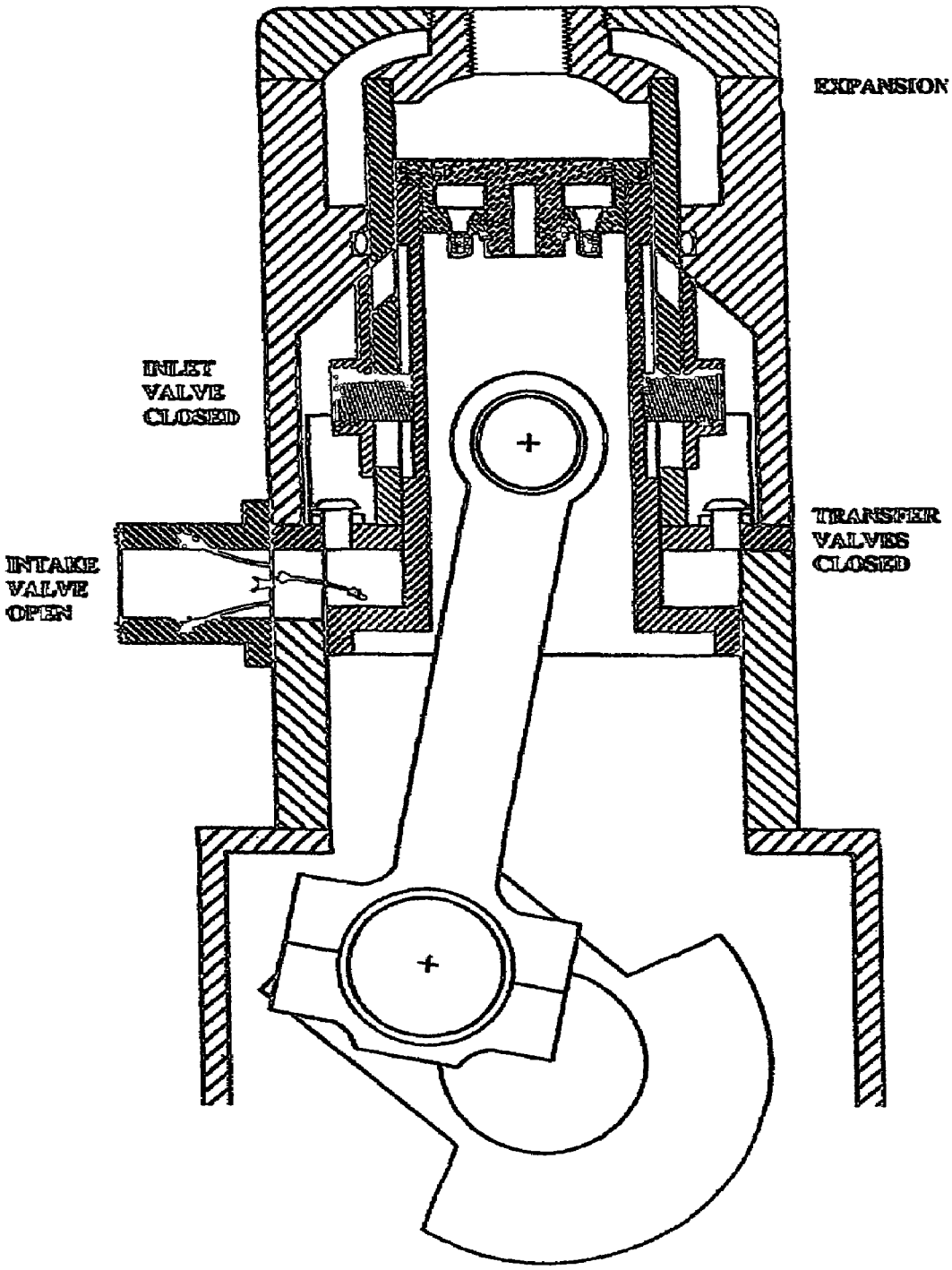
Figure 9:
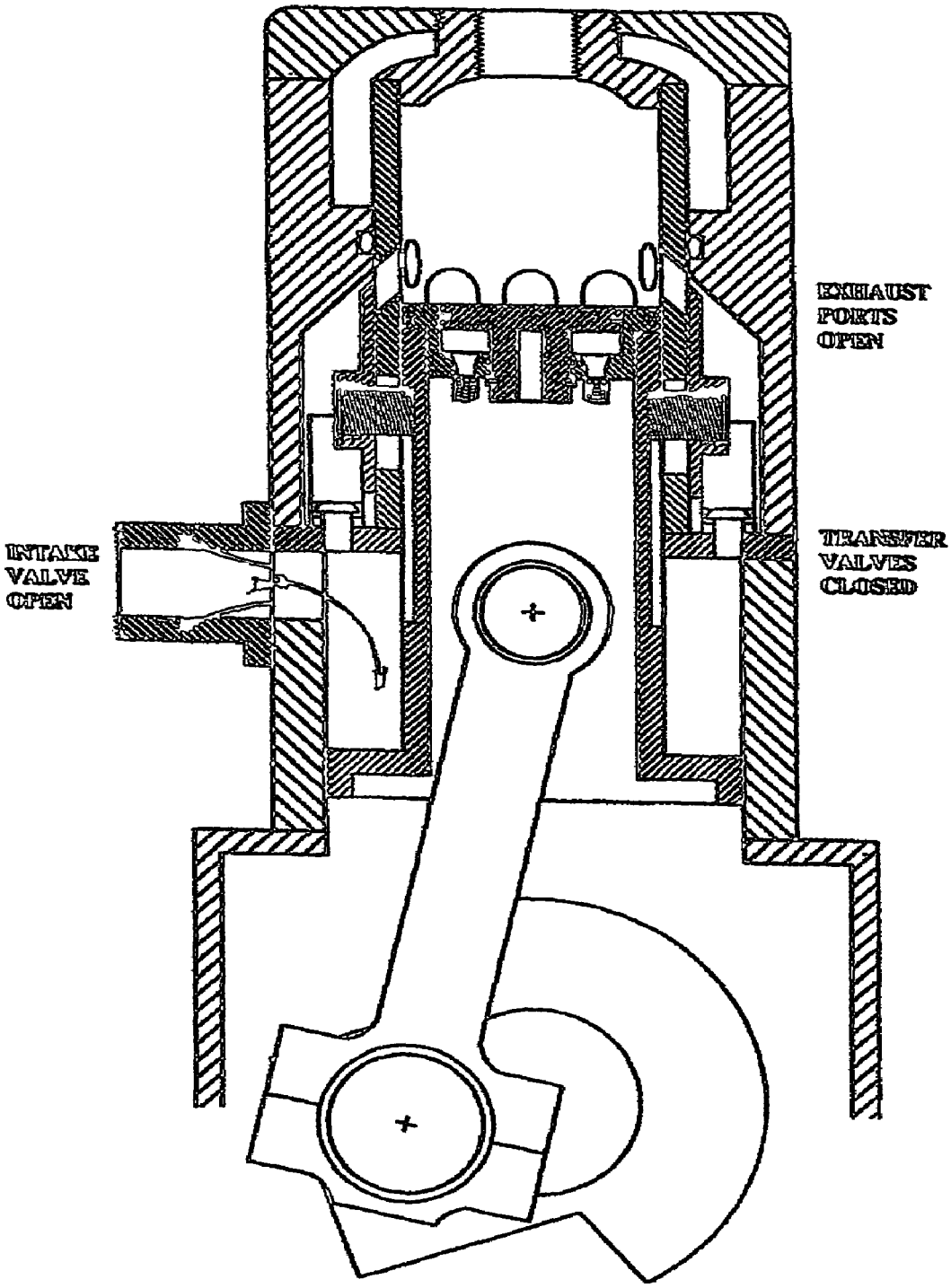
Figure 10:
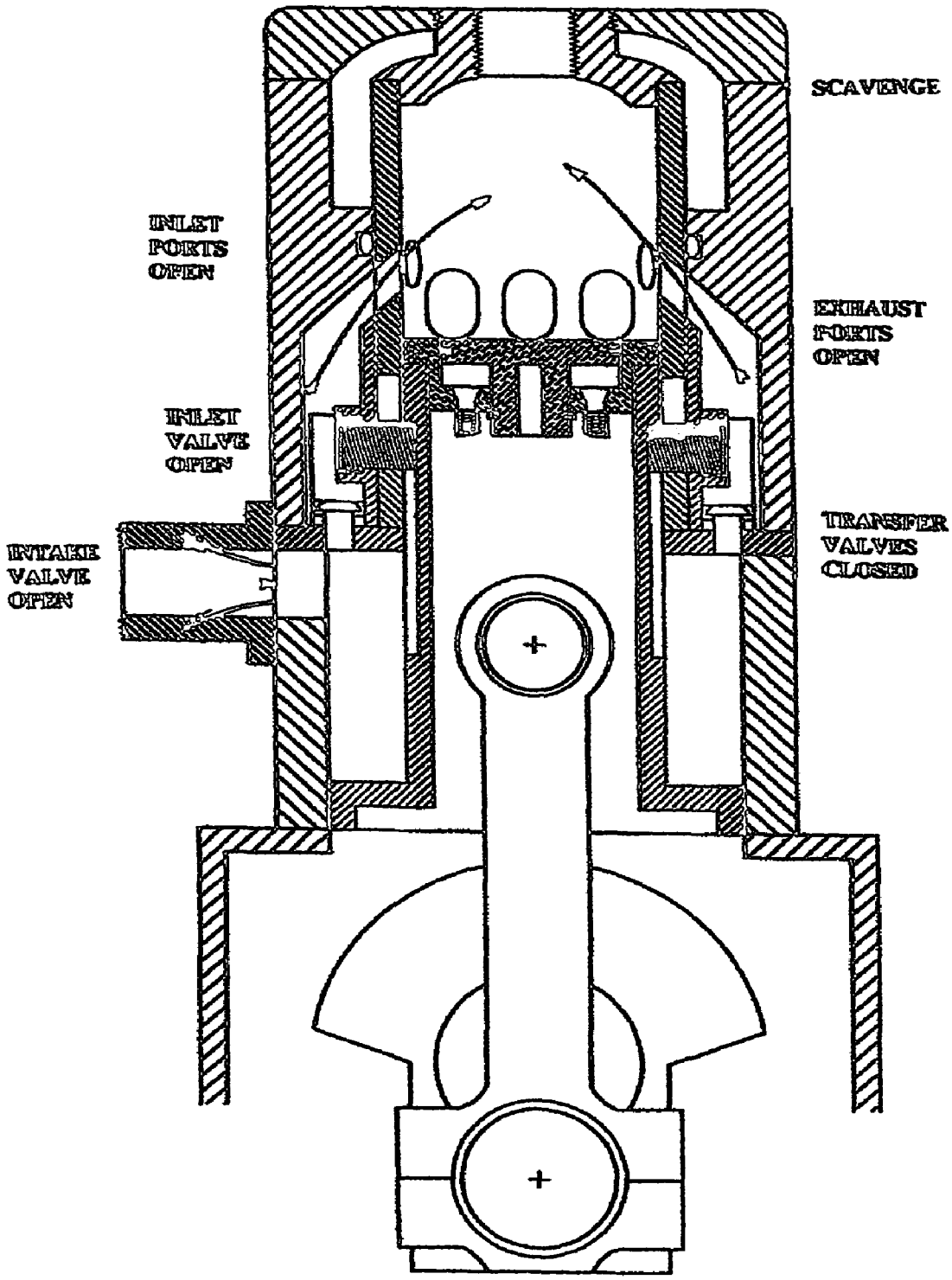
Figure 12:
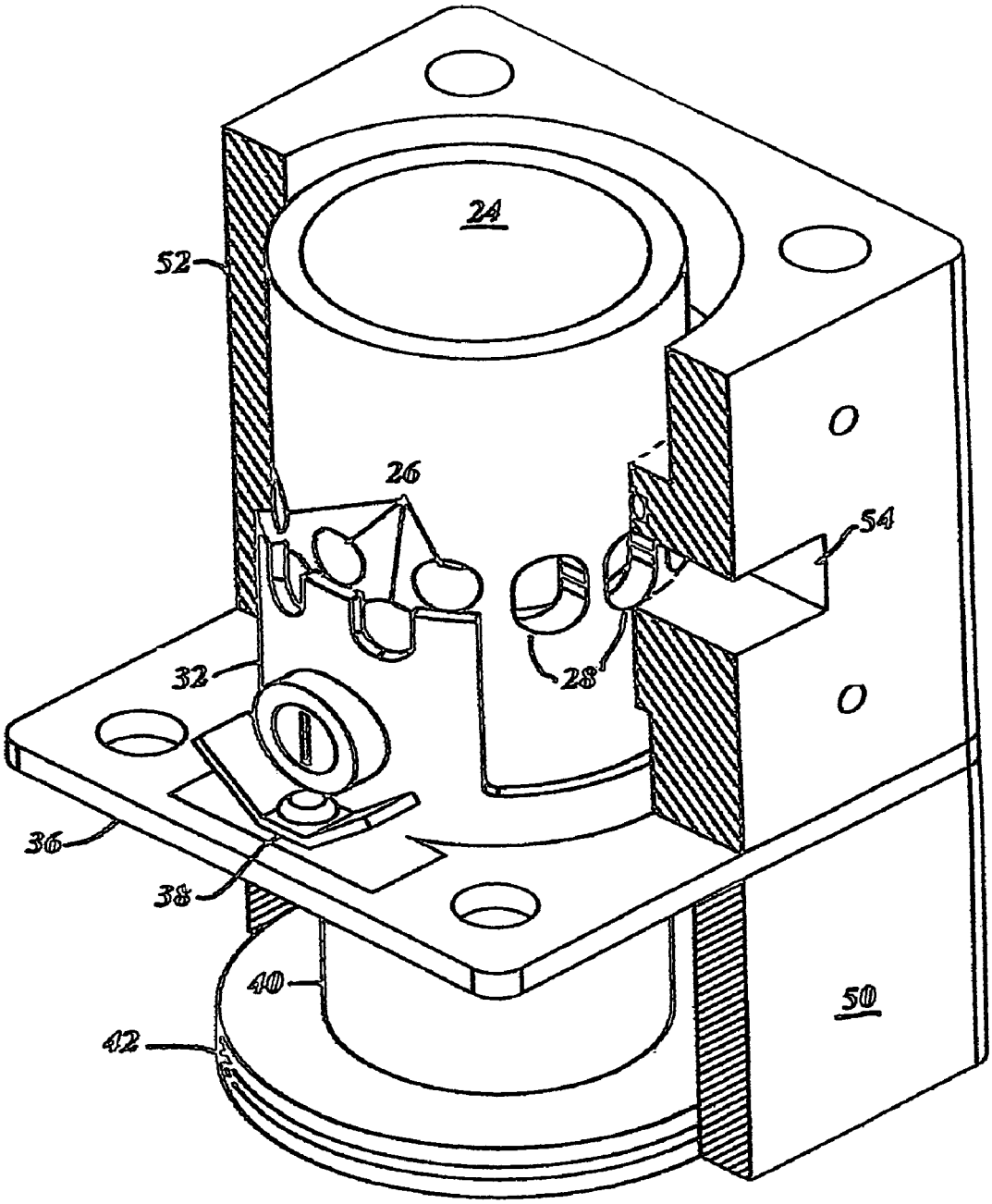
FIG. 12. is a vertical sectional isometric view of the principal parts of the invention, with the piston at bottom dead center with the reciprocating shuttle inlet valve in the open position.
Figure 13:
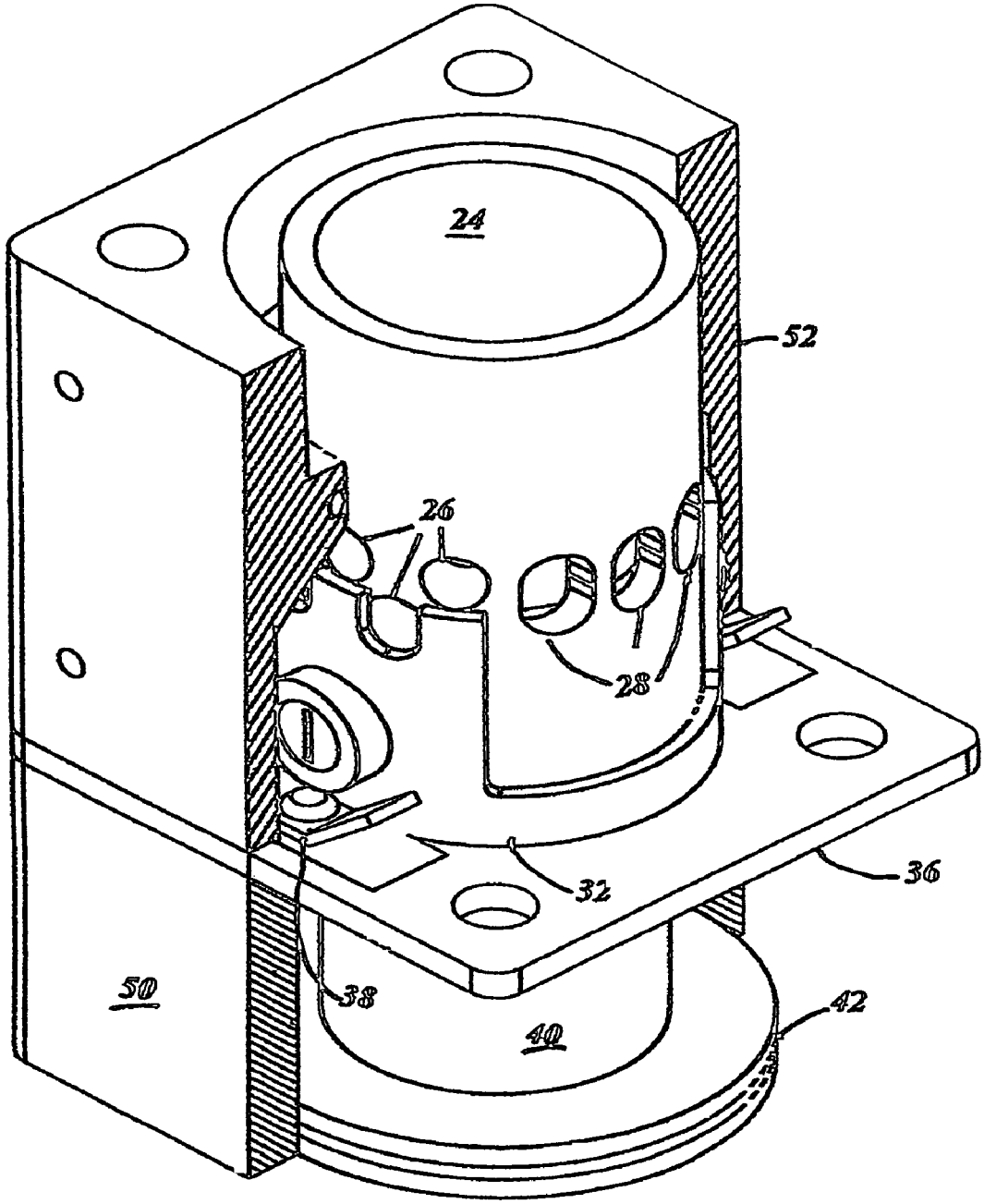
FIG. 13. is a vertical sectional isometric view of the principal parts of the invention, with the piston at bottom dead center with the reciprocating shuttle inlet valve in the open position.
Figure 14:
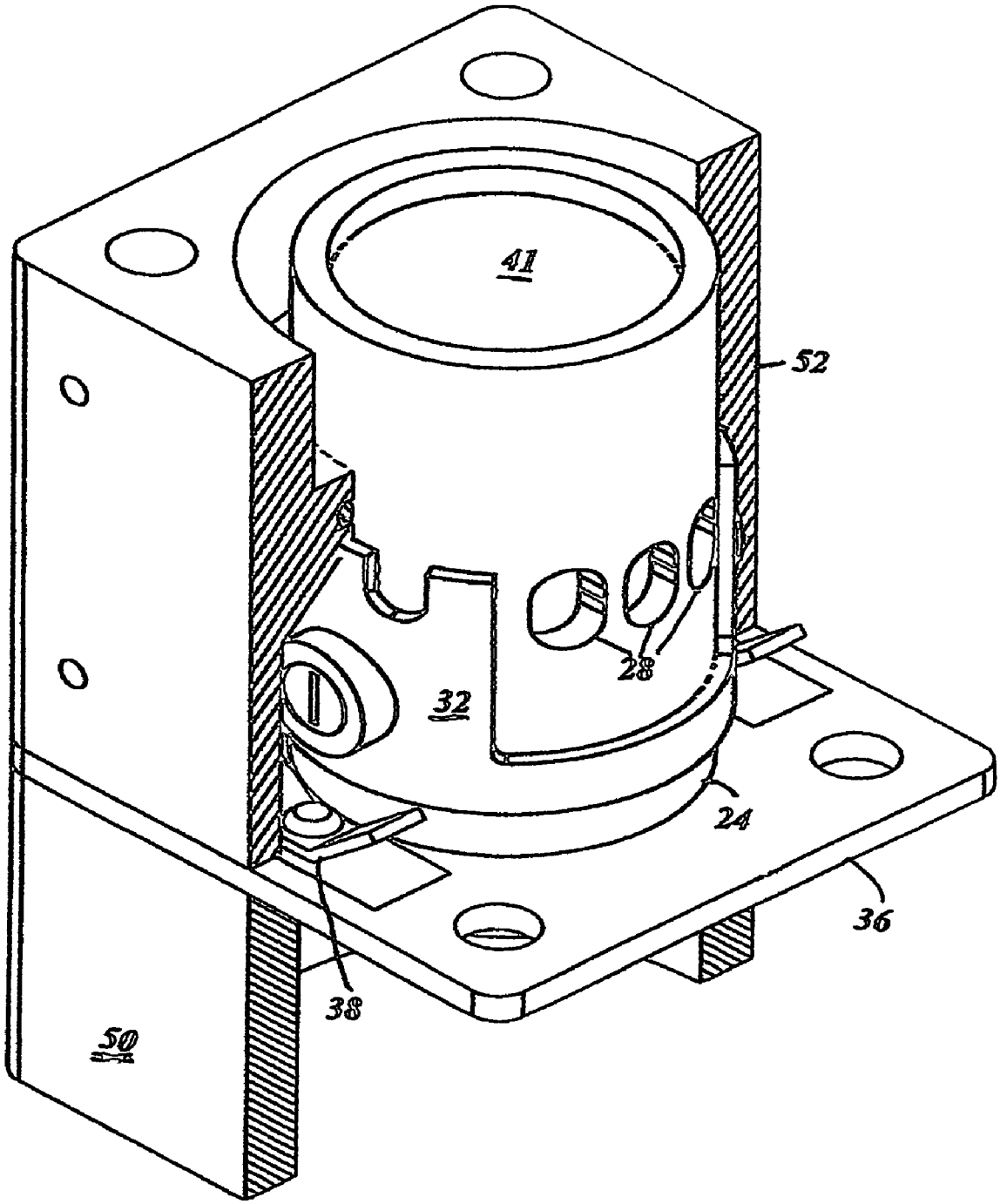
FIG. 14. is a vertical sectional isometric view of the principal parts of the invention, with the piston at top dead center with the reciprocating shuttle inlet valve in the closed position FIG. 15. is a vertical sectional isometric view of the principal parts of the invention, with the piston at top dead center with the reciprocating shuttle inlet valve in the closed position FIG. 16. illustrates various engine cylinders with compatible reciprocating shuttle inlet valves.
Figure 15:
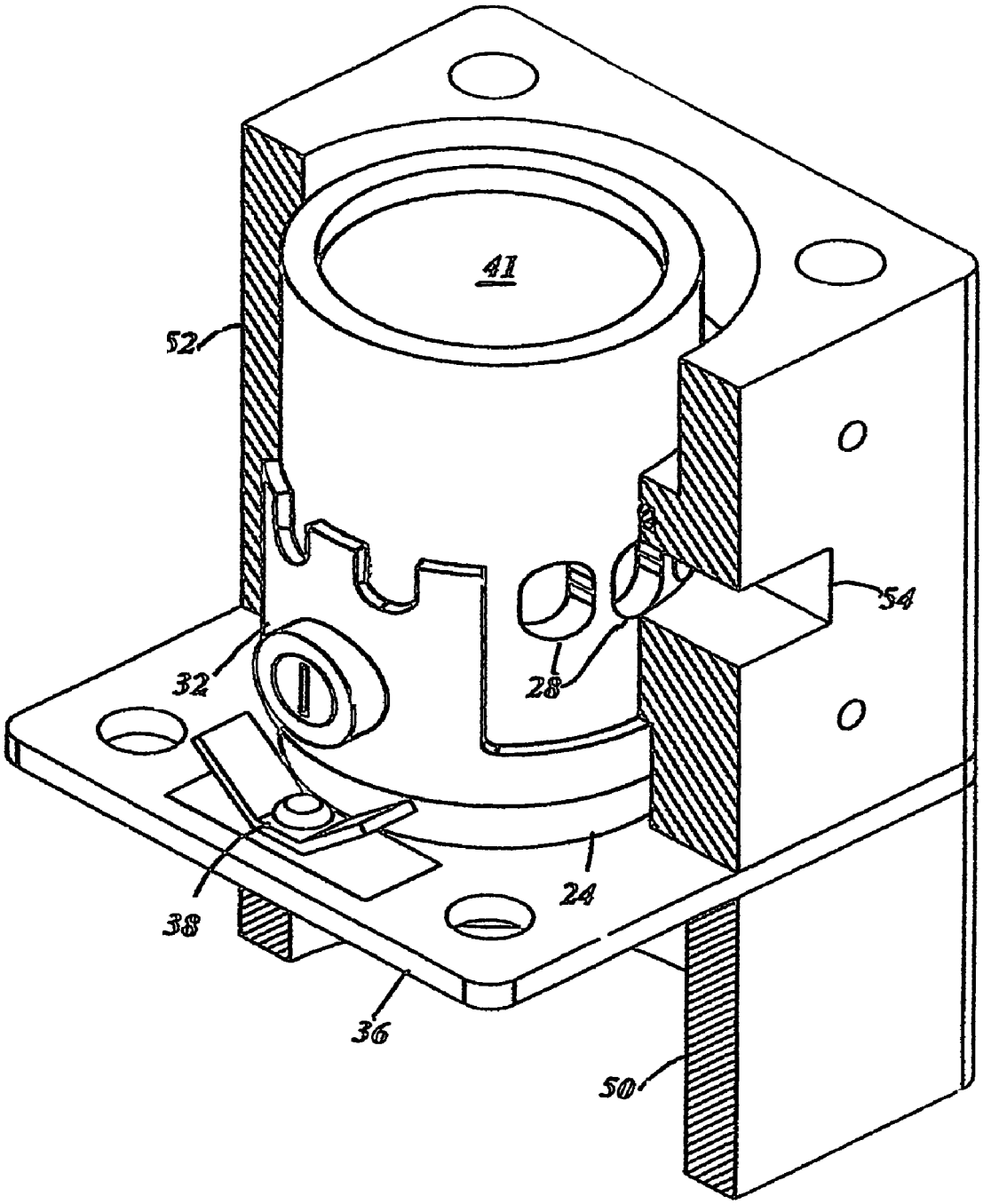
Figure 16:
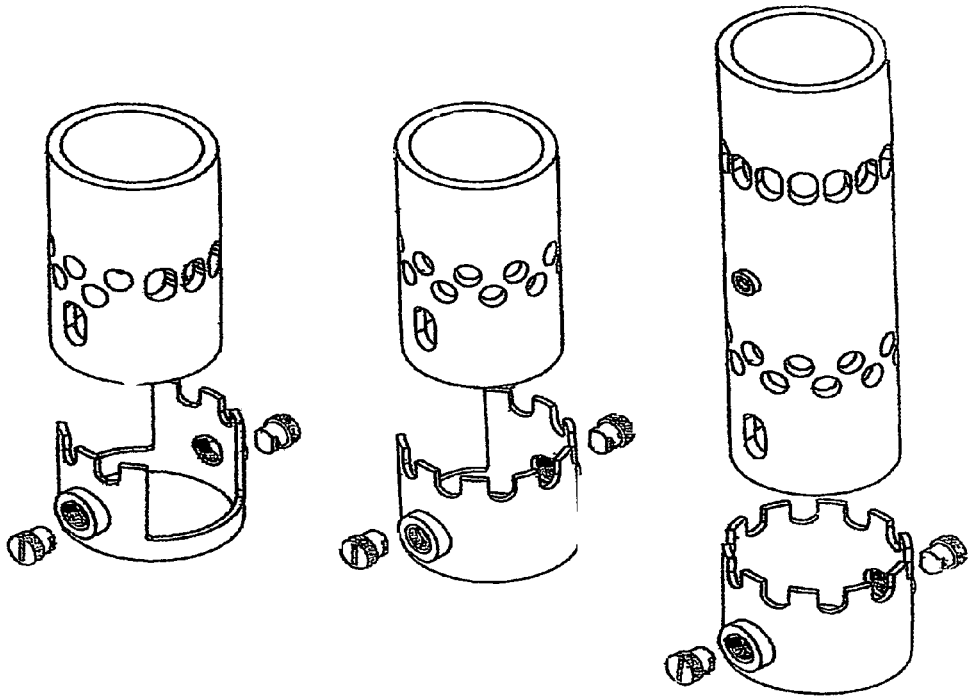
Figure 17:
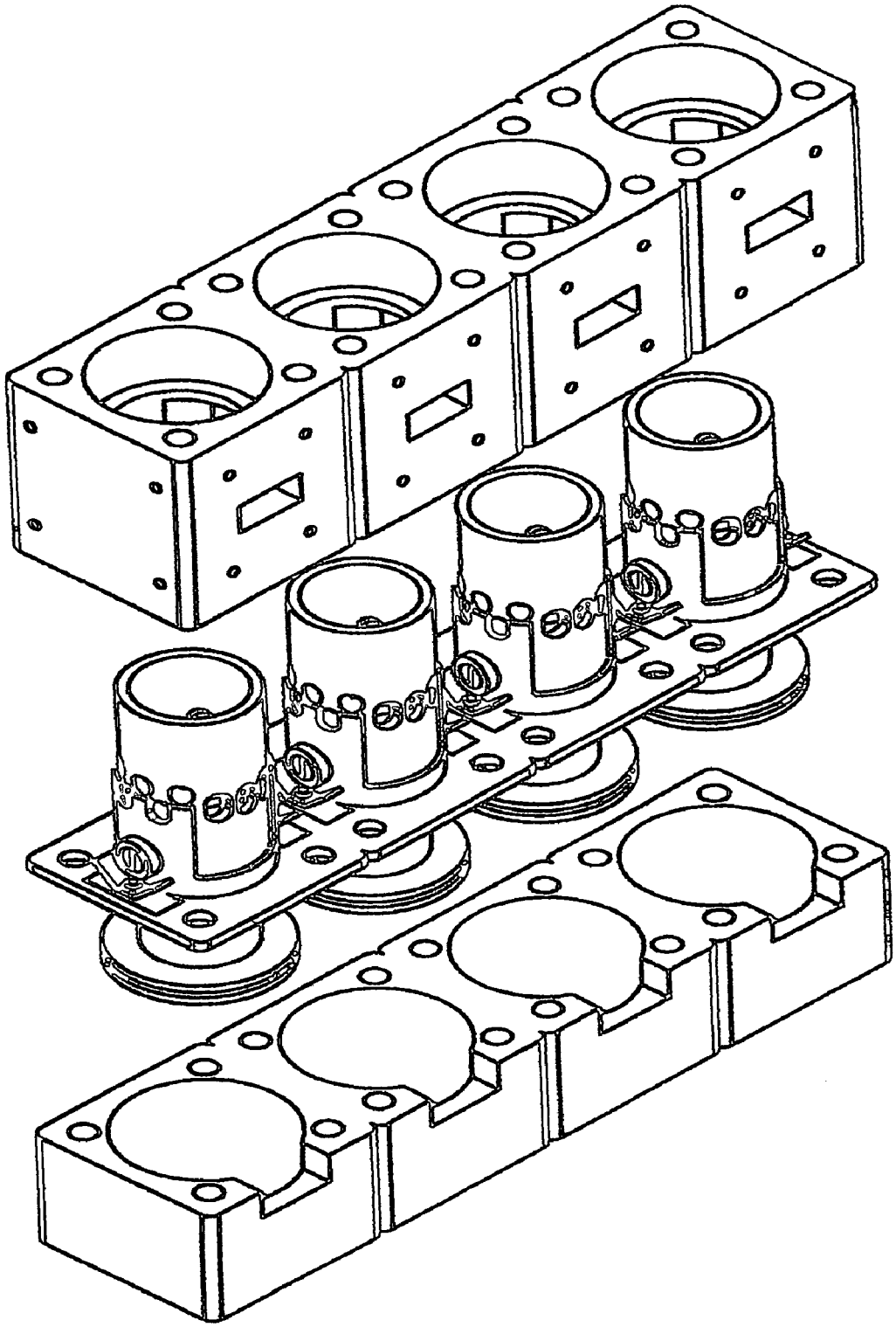
FIG. 17. is view of the invention in multiple cylinder form

24 power cylinder
26 inlet ports
28 exhaust ports
30 valve guide slot
32 reciprocating shuttle inlet valve
34 projections from reciprocating shuttle inlet valve
36 valve plate
38 transfer valve assembly
40 piston skirt
41 power piston
42 compressor piston
44 void formed in piston skirt
46 abutment to open reciprocating shuttle inlet valve
48 abutment to close reciprocating shuttle inlet valve
50 compressor cylinder
52 cylinder block
53 plenum
54 exhaust opening in cylinder block
56 cylinder head
58 crown of combustion chamber
60 inlet to compressor cylinder
62 intake valve assembly
64 piston ring
66 piston crown

DETAILED DESCRIPTION AND OPERATION OF THE PREFERRED EMBODIMENT OF THE INVENTION

Some conventional details of engine construction may not be described.

The sequence of operation is best described beginning with the piston at bottom dead center. As the power piston 41 begins it's upward stroke, the combined rising compressor piston 42 forces air past one-way transfer valves 38 in the valve plate 36 that separates the compressor cylinder 50 from the plenum 53. The air flows from the compressor cylinder 50 through the transfer valves 38 in the valve plate 36 into and through the plenum 53 and on through the open inlet ports 26, into the power cylinder 24, thereby filling the power cylinder 24 with a fresh air charge, assuring instant starting or further cleansing and cooling the power cylinder 24 of the previous combustion event. As the power piston 41 continues to rise, it covers the exhaust ports 28 preventing any further loss of air from the power cylinder 24. The charge of compressed air that continues to enter the power cylinder 24 from the plenum 53, through the open inlet ports 26, effectively supercharges the power cylinder 24. It can be seen that the amount of effective supercharge is the height of the inlet ports 26 that remain open after the exhaust ports 28 have closed. The compressor piston 42 continues to rise during the compression stroke, forcing a continuing charge of air through the transfer valves 38 in the valve plate 36 into the plenum 53, after the inlet ports 26 in the power cylinder 24 are covered by the rising power piston 41, this continuing charge of compressed air is retained in the plenum 53. As the compressor piston 42 reaches the end of the compression stroke the plenum 53 is fully charged and the transfer valves 38 in the valve plate 36 then close automatically. Lower abutments 48 in the piston skirt 40 then strike the projections from the reciprocating shuttle inlet valve 34 in the reciprocating shuttle inlet valves 32, thereby moving the reciprocating shuttle inlet valve 32 to close the inlet ports 26 in preparation for the next cycle. At this time, fuel injected into the power cylinder 24 is ignited by an electrical device (spark, glow plug etc.) or by the heat of the compressed air. At top dead center the ignition of the charge creates the expansion stroke forcing the power piston 41 downward. As the compressor piston 42 is moved downward during the expansion stroke it draws in a fresh charge through one-way intake valves to fill the compressor cylinder 50. As the power piston 41 descends toward the end of the expansion stroke, the exhaust ports 28 are uncovered by the power piston 41. After an amount of combusted gas has left the power cylinder 24 through the exhaust ports 28, the upper abutments 46 in the piston skirt 40 strikes the projections 34 in the reciprocating inlet valve 32, forcing reciprocating shuttle inlet valve 32 to open and permitting the previously compressed air charge in the plenum 53 to enter the power cylinder 24, through the now opened inlet ports 26, to evacuate the combusted gasses remaining in the power cylinder 24. As the power piston 41 begins to rise the sequence of operation is repeated. The power piston 41 is constructed with a piston crown 66, surrounded by a piston ring 64.

The reciprocating shuttle inlet valve 32 is advantageously reciprocated by projections 34 joined as an integral part of the reciprocating shuttle inlet valve 32. The projections 34 project radially in an inward direction and pass through guiding slots 30 formed in the cylinder 24 and continue through the cylinder 24 to occupy a space between grooves, channels or voids 44 formed in the piston skirt 40, with means included to prevent the projections from contacting either the sides or the bottom of the grooves, channels or voids 44 formed in the piston skirt 40. The ends of the grooves, channels or voids 44 formed in the piston skirt 40 form abutments 46 and 48 that defines the limits of travel of, and control the movements of the reciprocating shuttle inlet valve 32. As the piston 40 reciprocates the abutments 46 and 48 formed at the opposite ends of the grooves, channels or voids 44, strike the projections 34, forcing the reciprocating shuttle inlet valve 32 to reciprocate back and forth in response to the reciprocating piston 41 and be moved to its open or closed position.

CONCLUSION, RAMIFICATIONS AND SCOPE OF THE INVENTION

As a result of this very advanced two-cycle in-cylinder combustion technology, additional benefits are permitted, that may include, higher, more efficient compression ratios, with reduced ignition delay and ultra fast multi-injection strategies, which can employ or add different types of fuels or additives, such as hydrogen, water, alcohol, methane, butane etc., significant reductions in hydrocarbon and nitrogen oxide emissions into the atmosphere are attainable, thereby increasing the range of usefulness of the two-cycle engine into areas now dominated by the four-cycle engine. With the arrangements disclosed, the great potential of two-cycle engines, with their enormous benefits combined with their appealing simplicity, is finally realized.

The invention provides a new construction of valve in which all the disadvantages of the two-cycle engine are avoided or mitigated.

Unlike crankcase compression engines or previously constructed stepped-piston engines, the reciprocating shuttle inlet valves permit a continued flow of air under pressure into the cylinder after the exhaust ports have been closed The reciprocating shuttle inlet valve construction is distinguished by its extreme simplicity and consists of a single and simple member requiring no additional parts or precise manufacture, that is relatively inexpensive to manufacture, is effective and reliable in operation and is easy to install, remove, and/or service, retaining the relative simplicity of the two-cycle engine. The invention permits opposed pistons in that engine type to operate in unison, providing a simpler and more compact construction in which the oppositely moving pistons and power transmitting mechanisms are arranged symmetrically, producing a substantially perfect balance of the moving parts.

The absence of mechanical connections reduces the number of moving parts of the engine, thereby considerably reducing costs and maintenance requirements and increasing reliability.

Only a very small movement of the reciprocating shuttle inlet valve is needed to rapidly and simultaneously open all the inlet ports in the cylinder, presenting the maximum throughway area to the air possible in the minimum amount of time, permitting the cylinder to very quickly fill with air from a crankcase, supercharged manifold or plenum It should be noted that due to the total absence of any complex mechanical connections, the reciprocating shuttle inlet valve is a single and simple element that may be easily and inexpensively mass produced by any suitable method of manufacture, thereby considerably reducing costs and maintenance requirements and increasing reliability. An extreme degree of gas-tightness is not necessary, so that an adequate running clearance is very easily arranged, without prejudicing the action or in any way inhibiting the reciprocating shuttle inlet valves performance.

A substantially flat valve in contact with a complimentary flat surface formed on the side of an engine cylinder is another form the invention may take.

Permitting a constant and very close relationship between the rim of the crown of a piston and cylinder head in one embodiment of the invention and the rims of the crowns of opposed-pistons at top dead center in another embodiment of the invention, forming squish bands that squeezes the swirling air and fuel mixture at a very high velocity into the piston combustion bowls, assuring that the air and fuel will be thoroughly mixed and excited into a highly turbulent state and that combustion is completed in the shortest possible time and eliminate any pockets of unburned fuel. The lack of a squish area in a combustion chamber is highly disadvantageous due to the less favorable ignition conditions, creating increased noxious emissions.

There may be as many port openings, as in the judgment of the engine designer is proper for an individual configuration, but for the purpose of disclosing my invention to those skilled in the art it is not necessary to show and describe more than the number of valves shown, including the arrangements and number of ports and the direction of flow of the charge into the cylinder and is not limited to those shown and described.

The cylinder may be formed with a groove (not shown) holding a piston ring or some similar outwardly spring-like device that may be employed and placed between the cylinder and the reciprocating shuttle inlet valve to firmly maintain the reciprocating shuttle inlet valve in either the open or closed position. This arrangement is of benefit in some configurations requiring a large cylinder and reciprocating shuttle inlet valve arranged in a vertical position, particularly in low and medium speed diesel engines.

The internal stepped-piston supercharging arrangement eliminates the complication and very high cost of all previous "add on" supercharging means that must employ separate, complex mechanically driven devices, requiring precise and expensive manufacture and assembly, with all the necessary connections to the engine shaft and all their known problems relating to cost, maintenance, service life, dependability and replacement, or with exhaust driven turbochargers, employing difficult to arrange induction and exhaust manifolds, with disadvantages that involve very high initial and replacement cost, throttle lag with severe lubrication and cooling challenges.

Giving the stepped-piston the dual role of supercharger at one end, eliminating the mixing of air, lubricating oil and fuel in the crankcase and instead by forming a "bounce space" within the dry sump area below the stepped-piston, thereby creating a pumping chamber in the crankcase of the engine that permits the use of a high pressure lubrication and oil cooling system that may also eliminate lubrication or coolant pumps that would normally be operated with connections to the engine shaft.

Providing the major advantages of an efficiently supercharged two-cycle engine, which is increased horsepower from an engine of given weight or displacement and a supercharged engine usually costs less than a naturally aspirated engine of the same power, with increased fuel economy and reduced emissions.

Although various embodiments have been shown and described, it should be understood that the invention is capable of modification and that changes in construction and in arrangement of the various cooperating parts may be made without departing from the spirit or scope of the invention. As an example, the invention is applicable to multiple cylinder engines that may be arranged in an In-line, "V", Opposed-piston, Barrel or any other convenient arrangement.

It is also apparent that the present invention is applicable for use with any of the many various mechanical arrangements and structures that have or may be employed to convert the reciprocating movements of the pistons in their cylinders to rotary motion.

Thus the scope of the invention should be determined by the appended claims and their legal equivalents, rather than by the examples given.

The embodiments of the invention for which an exclusive property or privilege is claimed are defined as follows:

The invention claimed is:

1. A method for controlling the movements of a reciprocating shuttle inlet valve for an engine operating on the two-stroke cycle, comprising, a cylinder, said cylinder having a piston reciprocating within said cylinder, an exhaust port formed in said cylinder, an inlet port formed in said cylinder, a reciprocating shuttle inlet valve arranged to reciprocate on the outside of said cylinder, with at least one projection formed as an integral part of said reciprocating shuttle inlet valve, with at least one said projection projecting radially inward, passing through at least one aligning slot formed in said cylinder, with at least one said projection occupying a space within at least one groove, channel or void formed in the skirt of said piston, with means to avoid contact of said one least projection and said one least groove, channel or void, with means to permit at least one said projection to make contact with at least one abutment formed at the ends of at least one said groove, channel or void, causing contact of at least one said projection and of at least one said abutment, to axially reciprocate said reciprocating shuttle inlet valve, to either cover or uncover said inlet port, as said piston reciprocates within said cylinder.

2. The method of claim 1 further including, in combination, a cylinder with a cylinder head, said cylinder having a piston reciprocating within said cylinder with said piston forming a combustion space between the crown of said piston and said cylinder head, an exhaust port formed in said cylinder, an inlet port formed in said cylinder arranged nearer to said cylinder head than said exhaust port.

3. The method of claim 1 further including, in combination, a cylinder having two opposed-pistons reciprocating in opposition and substantially in unison to one another, within said cylinder, with each of said opposed-pistons forming a combustion chamber between the crowns of said opposed-pistons.

4. The method of claim 1 further including, in combination, a stepped cylinder block combining a power cylinder of smaller diameter and a compressor cylinder of larger diameter, a cylinder head covering said power cylinder, said stepped cylinder block having a stepped piston reciprocating within said stepped cylinder block with the smaller diameter of said stepped piston forming a combustion space between the crown of said smaller diameter of said stepped piston and said power cylinder head, said larger diameter of said stepped cylinder block and said larger diameter of said stepped piston form internal supercharging means, with at least one one-way transfer valve between said larger diameter cylinder and said smaller diameter cylinder, a manifold, plenum or accumulator is provided between said at least one one-way transfer valve and a reciprocating shuttle inlet valve arranged to cover and uncover an inlet port formed in said power cylinder, as said larger diameter piston reciprocates within said larger diameter cylinder, the rising of said larger diameter piston forces air through said at least one one-way transfer valve that separates said larger diameter cylinder into said manifold, plenum or accumulator and through said inlet port in said power cylinder, thereby filling said power cylinder with an air charge, as said power piston continues to rise, said power piston covers said exhaust port, preventing any further loss of air out of said power cylinder, the charge of air that continues to enter said power cylinder effectively supercharges said power cylinder, the amount of supercharge is determined by the amount of said inlet port that remains open after said exhaust port has been covered by said power piston, as said larger piston continues to rise during the compression stroke of said power piston, said larger piston forces the remaining charge of air in said larger cylinder through said at least one one-way transfer valve into said manifold, plenum or accumulator after said inlet port has been closed by said power piston, a quantity of compressed air is thereby contained in said manifold, plenum or accumulator until said reciprocating shuttle inlet valve is opened after said exhaust port opens toward the end of the power stroke to permit the initial scavenging of said power cylinder.

* * * * *